United States Patent [19]

Bröker

[11] Patent Number: 4,505,698

[45] Date of Patent: Mar. 19, 1985

[54] SELF-EMPTYING CENTRIFUGE DRUM

[75] Inventor: Klaus-Dieter Bröker, Oelde, Fed. Rep. of Germany

[73] Assignee: Westfalia Separator, Oelde, Fed. Rep. of Germany

[21] Appl. No.: 585,795

[22] Filed: Mar. 2, 1984

[30] Foreign Application Priority Data

Mar. 10, 1983 [DE] Fed. Rep. of Germany ..... 3308505

[51] Int. Cl.[3] ..... B04B 3/08

[52] U.S. Cl. ..... 494/40

[58] Field of Search ..... 494/40, 41, 38, 27, 494/30; 210/360.1, 781, 782, 369, 376

[56] References Cited

U.S. PATENT DOCUMENTS

| | | | |
|---|---|---|---|
| 2,840,302 | 6/1958 | Steinacker | 494/40 |
| 3,193,194 | 7/1965 | Steinacker | 494/40 |
| 3,462,076 | 8/1969 | Steinacker | 494/40 |
| 3,765,599 | 10/1973 | Hemfort | 494/40 |
| 4,151,951 | 5/1979 | Kohlstette | 494/40 |

*Primary Examiner*—Robert W. Jenkins

*Attorney, Agent, or Firm*—Sprung, Horn, Kramer & Woods

[57] ABSTRACT

A self-emptying centrifuge drum has a piston slide that controls openings in the jacket. The piston slide is fastened without play and without axial motion to the drum in the vicinity of the inner centering surface. The requisite axial motion of the slide in the vicinity of the outer centering surface is ensured by an elastically deformable area with an axial spring coefficient that is low in relation to its radial rigidity. This novel way of guiding the piston slide, prevents one-sided frictional forces in the vicinity of the centering surfaces with concomitant wear as well as irregular opening of the slide.

6 Claims, 5 Drawing Figures

SELF-EMPTYING CENTRIFUGE DRUM

BACKGROUND OF THE INVENTION

The present invention relates to a self-emptying centrifuge drum with ejection openings which are controlled by an axially movable piston slide, and with inner and outer centering means associated with the piston slide inside the drum, the outer centering means allowing the slide to move axially.

A self-emptying centrifuge drum of this type is known, for example, from German Pat. No. 3 019 737. The piston slide can move axially in the vicinity of both the outer and inner centering means. Since the inner centering means usually has the lower tolerance, it assumes actual guidance of the piston slide. Self-emptying centrifuge drums of the known type are balanced subsequent to assembly to eliminate disequilibriums dictated by the manufacturing process. This leads the piston slide, which is not separately balanced, to acquire its own inherent disequilibrium so that forces will occur during operation that displace the slide to one side inside the drum. The slide will thus come to rest at one side against the inner centering means with a force that is proportional to its inherent disequilibrium, producing frictional forces at this point as the piston slide moves axially. These one-sided frictional forces lead not only to an irregular opening of the ejection openings when the drum empties, but also cause uneven wear on the inner centering means. Since the piston slide lifts only a few tenths of millimeters off the sealing surface during what is called partial emptying, irregular opening leads to non-uniform solids ejection and hence, finally, to dangerous drum disequilibriums.

SUMMARY OF THE INVENTION

The object of the present invention is to design the centering means of the piston slide to eliminate one-sided frictional forces during the axial motion of the slide.

This object is attained in accordance with the present invention wherein the piston slide is fastened without play and without axial motion at the inner centering means and is provided with an axially elastically deformable area between the inner and the outer slide centering means that allows the piston slide to move axially but not radially in the vicinity of the outer centering means.

Rigidly fastening the piston slide to the centrifuge drum in the vicinity of the inner centering means and allowing axial movements in the vicinity of the outer centering means by elastic deformation of a part of the slide, allow movement of the slide with the elimination of its aforesaid associated drawbacks. The elastic area is designed to allow the piston slide to move slightly axially at the outer centering means, whereas an extremely rigid form is present radially. Since the inner piston-slide centering means is rigidly fastened to the centrifuge drum, the axial motion of the slide will be completely free of play and wear and without one-sided frictional forces. The tolerances in the vicinity of the outer centering means must naturally be high enough to make metal contact at this point impossible. The elastically deformable area can for example be a tubular-spring, a diaphragm-spring, or a rubber-spring articulation permanently or removably fastened to the piston slide. Additional forces can be exerted on the axially movable part of the piston slide in the opening or closing direction when the slide is appropriately built into the centrifuge drum with the elastically deformable area subject to axial tension.

Some preferred embodiments of the invention will now be described with reference to the attached drawings, wherein

DETAILED DESCRIPTION OF THE PREFERRED EMBODIMENTS

Figure 1:
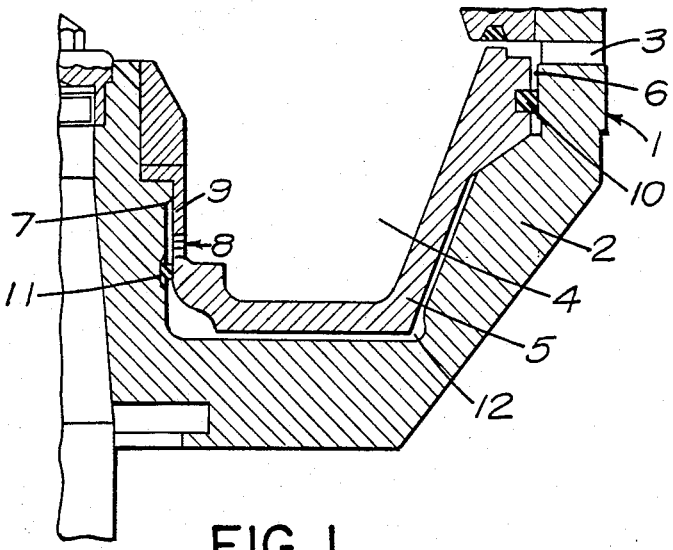
FIG. 1 illustrates a self-emptying centrifuge drum with an elastically deformable area in the form of a tubular-spring articulation.

The self-emptying centrifuge drum 1 in FIG. 1 has openings 3 for the ejection of the solids accumulated around the periphery in centrifuge space 4. The bottom of centrifuge space 4 is demarcated by a piston slide 5 that can slide axially in the vicinity of outer centering means 6 and is rigidly fastened to drum 1 in the vicinity of inner centering means 7. Part of piston slide 5 comprises an elastically deformable area 8 in the form of a tubular-spring articulation 9 that allows the slide 5 to move slightly axially at outer centering means 6 but prevents it from moving radially. Sealing rings 10 and 11 in the vicinity of centering means 6 and 7 seal off centrifuge space 4 from a closure-water chamber 12. When the chamber is full, piston slide 5 is initially in its upper position, in which it blocks off openings 3. When closure water is bled off through a valve that is not illustrated, slide 5 is forced down by the pressure of the liquid in centrifuge space 4, whereupon tubular-spring articulation 9 extends, following the downwards motion of the slide and simultaneously assuming the radial guidance of piston slide 5. Refilling closure-water chamber 12 with closure water restores slide 5 to its upper position. Outer centering means 6 is dimensioned to provide a large enough clearance to prevent metallic contact and has merely a sealing function.

Figure 2:
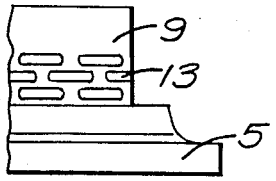
FIG. 2 is a side view of the tubular-spring articulation.

FIG. 2 is a view of the tubular-spring articulation 9 of piston slide 5 and illustrates one possible approach to manufacturing such an articulation in the form of a regular pattern of superimposed slits 13.

Figure 4:
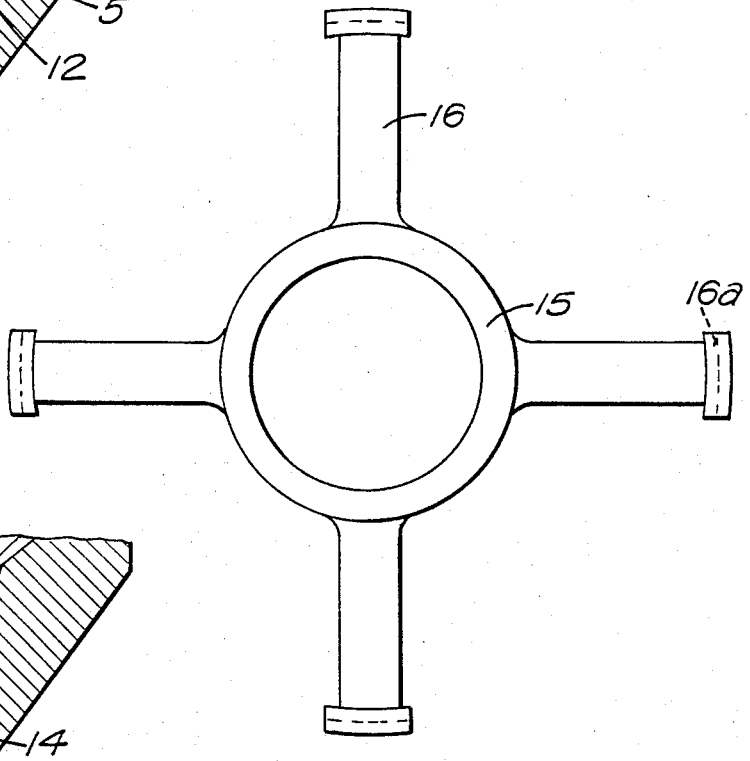
FIG. 4 is a top view of the diaphragm-spring articulation.
Figure 3:
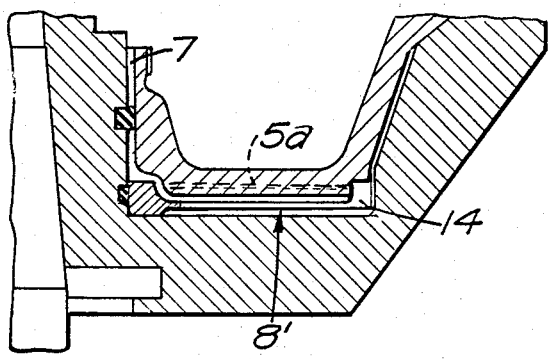
FIG. 3 illustrates a piston slide with a diaphragm-spring articulation screwed onto it.

Elastically deformable area 8' can also be a diaphragm-spring articulation 14 screwed onto piston slide 5 as illustrated in FIGS. 3 and 4. Diaphragm-spring articulation 14 consists of a centering ring 15 fastened to centrifuge drum 1 and of resilient diaphragm rods 16 fastened to slide 5 at internally threaded axial portions **16*a* which engage external threads 5*a* on slide 5. Diaphragm rods 16 conform to the axial motion of piston slide 5**, but because of their radial rigidity, prevent radial motion, simultaneously ensuring the optimal centering of the slide.

Figure 5:
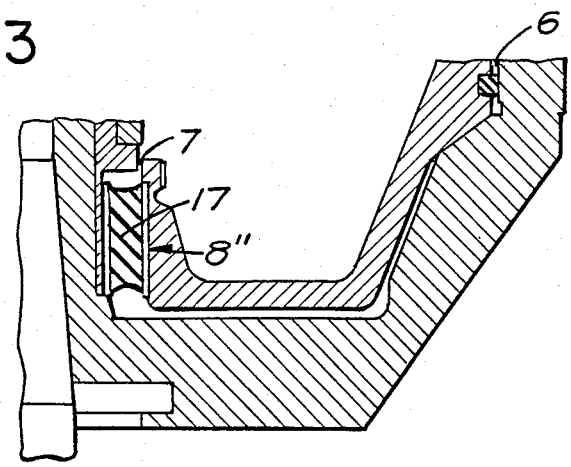
FIG. 5 illustrates a piston slide with a rubber-spring articulation forced into it.

The elastically deformable area 8'' illustrated in FIG. 5 is a rubber-spring articulation 17 forced inside the slide. Since this articulation also has a low axial spring constant and a high radial spring constant, metallic contact can also be prevented if the clearance between the outer centering means 6 and the drum is sufficient.

It will be appreciated that the instant specification and claims are set forth by way of illustration and not limitation, and that various modifications and changes may be made without departing from the spirit and scope of the present invention.

What is claimed is:

1. In a self-emptying centrifuge drum with ejection openings controlled by an axially movable piston slide rotatable with the drum about an axis of rotation and having an inner surface facing the axis of rotation and an outer surface facing the drum, inner and outer centering means associated with the respective inner and outer surfaces of the piston slide and inside the drum for centering the piston slide relative to the axis of rotation, the outer centering means allowing the slide to move axially, the improvement comprising means mounting the piston slide to the drum without play and without axis motion at the inner centering means and axially elastically deformable means disposed between the inner and the outer slide centering means for allowing the piston slide to move axially and not radially in the vicinity of the outer centering means.

2. The self-emptying centrifuge drum as in claim 1, wherein the elastically deformable means comprises a tubular-spring articulation in a portion of the slide.

3. The self-emptying centrifuge drum as in claim 1, wherein the elastically deformable means comprises a diaphragm-spring articulation connected to the slide.

4. The self-emptying centrifuge drum as in claim 1, wherein the elastically deformable means comprises a rubber-spring articulation connected to the slide.

5. The self-emptying centrifuge drum as in claim 1, wherein the elastically deformable means comprises means removably fastened to the piston slide.

6. The self-emptying centrifuge drum as in claim 1, wherein the piston slide is built in to the drum with the elastically deformable means subject to axial tension.

* * * * *